United States Patent [19]

Bresie et al.

[11] Patent Number: 4,483,376

[45] Date of Patent: Nov. 20, 1984

[54] NATURAL GAS LOADING STATION

[76] Inventors: Don A. Bresie; Jack M. Burns; Donald W. Fowler, all of 5407 N. IH 35, Austin, Tex. 78723

[21] Appl. No.: 415,420

[22] Filed: Sep. 7, 1982

[51] Int. Cl.[3] ..... F17C 5/02

[52] U.S. Cl. ..... 141/95; 141/4; 141/196; 141/231; 141/248; 280/12 M

[58] Field of Search ..... 48/190; 108/51.1, 55.1; 141/4, 13, 95, 97, 153, 196, 197, 231, 232, 235, 248, 270, 284, 387; 175/5, 7; 182/113, 142; 248/346; 280/12 M; 405/195, 196, 201, 203, 204, 207, 208; 137/12, 121, 625.1

[56] References Cited

U.S. PATENT DOCUMENTS

| | | | |
|---|---|---|---|
| 28,873 | 6/1960 | Lawson | 48/190 |
| 606,500 | 6/1898 | Barry, Jr. | 182/113 X |
| 847,727 | 3/1907 | Bruckner | 53/400 |
| 1,769,612 | 7/1930 | Wettstein | 137/12 |
| 2,011,347 | 8/1935 | Ragonnet | 222/3 |
| 2,087,300 | 7/1937 | Ragonnet | 410/68 |
| 2,102,686 | 12/1937 | Dunham | 222/3 |
| 2,395,415 | 2/1946 | Maier | 280/12 M |
| 2,761,397 | 9/1956 | Holst | 105/360 |
| 2,780,231 | 2/1957 | Westmoreland | 137/121 |
| 3,293,011 | 12/1966 | Lewis | 48/190 |
| 3,468,348 | 9/1969 | Sperberg | 141/4 X |
| 3,648,720 | 3/1972 | Kornahrens | 182/113 X |
| 3,837,377 | 9/1974 | McJones | 141/4 |
| 4,139,019 | 2/1979 | Bresie et al. | 137/569 X |
| 4,161,376 | 7/1979 | Armstrong | 405/201 X |
| 4,190,080 | 2/1980 | LeDevehat | 141/387 X |
| 4,213,476 | 7/1980 | Bresie et al. | 137/2 |
| 4,276,917 | 7/1981 | Fujita | 141/387 |
| 4,380,242 | 4/1983 | Bresie et al. | 137/113 |

FOREIGN PATENT DOCUMENTS 7646 of 1894 United Kingdom ..... 141/4

*Primary Examiner*—Stephen Marcus
*Assistant Examiner*—Mark J. Thronson
*Attorney, Agent, or Firm*—Francis B. Francois; Francis D. Thomas, Jr.

[57] ABSTRACT

The loading station of the invention includes an intake fitting, a pair of pressure operated motorized flow control valves, and a pair of loading boom assemblies that are all mounted on a movable equipment skid. The intake fitting is connectable with a source of high pressure natural gas, and the boom assemblies are universally adjustable and include coupler portions that are connectable with matching coupler portions carried on pressure vessels. Natural gas is loaded into the pressure vessels through the boom assemblies, and the loading station further includes a pressure control system that operates the motorized valves and which prevents natural gas from flowing into the boom assemblies when a pressure vessel is not connected thereto.

26 Claims, 8 Drawing Figures

300
CONTROLLER
SHUTTLE VALVE
OPTIONAL RECORDER
TO MOTOR VALVE
VENT
TO MOTOR VALVE
VENT
VENT
344
340
330
323
322
318
326
324
320
319
402
342
304
308
328
306
348
310
312
346
400
332
314
316
336
350
334
348
270
174
176
204
218
162
215
216
178
184
202
182
208
214
163
188
179
180
196
198
200
168
210
190
194
174
G1L
G2L
G3L
272
238
252
164
264
260
268
269
236
222
250
256
262
224
232
248
167
226
234
230
244
246
172
258
228
242
G1R
G2R
G3R

NATURAL GAS LOADING STATION

TECHNICAL FIELD OF THE INVENTION

The present invention relates to a natural gas loading station useable to load natural gas under high pressure into pressure vessels, and more particularly to an improved loading station arrangement that is movable from one gas well site to another and which includes a pressure-operated control system that will assure safe operation.

BACKGROUND OF THE INVENTION

The basic method and system for transporting natural gas under high pressure and at ambient temperatures in movable pressure vessels is described in U.S. Pat. No. 4,139,019, directed to an invention which made possible the recovery of natural gas from isolated or shut-in gas wells where the normal procedure of constructing a pipeline to the well was not feasible or not possible. The system described in that patent includes at least one pressure vessel mounted for transport, and designed to carry natural gas at ambient temperatures without refrigeration and at pressures ranging from 1500 to about 3000 psi.

In U.S. Pat. No. 4,139,019 an arrangement is described for loading natural gas into the movable pressure vessels, and usually includes an oil-gas separator unit and a dehydrator unit connected between the gas well and the loading equipment to properly condition the natural gas for transport. The loading equipment itself as described in the patent includes a loading manifold connected to receive natural gas for transport, at least one loading conduit connected with the loading manifold and having a flow-control valve therein, and a flexible conduit connected at one end to the loading conduit and equipped at its other end with a coupler portion designed to mate with a corresponding coupler portion carried on the movable pressure vessel. Usually, two loading conduits are connected to the loading manifold, so that two separate movable pressure vessels can be connected to the loading manifold at the same time. When the filling of one of the pressure vessels is completed, its associated flow-control valve is closed and the flow-control valve for the other pressure vessel is then opened to commence filling the latter.

The present inventors made improvements on the basic method and system of U.S. Pat. No. 4,139,019, and obtained U.S. Pat. No. 4,213,476 on those improvements. In the latter patent an improved method and system is described for producing and transporting natural gas, which again utilizes movable pressure vessels to transport natural gas at ambient temperatures and under a pressure that is preferably in the 2,000 to 3,000 psi range. The arrangement for loading natural gas into the movable pressure vessels is similar in the two patents, but U.S. Pat. No. 4,213,476 includes the added feature of providing a means to effect automatic switchover from a filled to an empty pressure vessel, with no interruption in natural gas flow. This feature assures continuous production of the gas well even if an operator is not present to effect a switchover manually.

The inventions which are the subject of these two patents have proved successful in practice, and have made it possible to recover natural gas from isolated gas wells. However, it has been found that the natural gas loading equipment as described in the two patents, while satisfactory in many situations, has some disadvantages. For example, the loading manifold and loading conduit arrangements shown in the patents normally require considerable construction at the well head, which can sometimes be expensive relative to the natural gas produced. In addition, the flexible hoses utilized to connect the loading conduits with the pressure vessels are subject to intensive wear because of the high pressures utilized, and need to be replaced rather frequently. Further, the flexible hoses can pose safety problems in handling and use, under certain circumstances.

There is need for an improved natural gas loading station for use in most efficiently practicing the natural gas production and transporting methods set forth in the two noted United States patents, one which is portable so that it can be moved from site to site, and which includes features to assure the maximum handling safety for the natural gas. The present invention is intended to meet that need.

BRIEF SUMMARY OF THE INVENTION

The natural gas loading station of the present invention is intended to be moved from place to place, and is connected to a source of ready-to-transport natural gas at the well head to effect loading thereof into movable pressure vessels. The loading station does not include the equipment for preparing the natural gas for transport, such as a compressor, a dehydrator unit or an oil/gas separator, but rather is intended to take the gas in a prepared, high pressure condition ready for loading and transport.

The loading station includes a specially designed equipment skid, which requires no foundation or footings at the gas well site, and that has tapered and rounded ends to facilitate sliding it on or off a transport vehicle and moving it into position. The equipment skid features an upright railing that extends around the skid's load platform, and which has an opening on the rear side of the skid to allow access to the platform. The railing helps support the control boxes and other components of the loading station, and also functions to keep passersby from any possible damaging contact with the critical components. Thus, it contributes to assuring safe handling of the natural gas.

The equipment skid carries loading apparatus designed to be connected with at least two pressure vessels at the same time. If desired, the skid could be made larger, and more loading apparatus could be added to handle a greater number of pressure vessels. However, it has been found that a two-station arrangement is normally entirely adequate to practice the methods that are described in the two cited patents cited above.

The loading apparatus mounted on the equipment skid includes a T-shaped intake fitting that has an intake flange for connection to the source of natural gas, the fitting acting as an intake manifold. The other legs of the T-shaped intake fitting extend to opposite sides of the equipment skid, and each is connected to one of a pair of motorized control valves. The outlets of the motorized valves are each connected to a uniquely designed adjustable loading boom assembly through a back-up manual control valve and a one-way check valve that prevents backflow from the pressure vessels being loaded. The loading boom assemblies are constructed of high strength rigid tubing and high-pressure swivel couplings to assure safety and long life, the swivel couplings being uniquely arranged to provide universal positioning capability to a quick connect-disconnect connector portion carried on the outer end of each boom. The boom assembly connector portions are designed to mate with corresponding connector portions carried by the pressure vessels.

A control box for each motor valve is also mounted on the equipment skid, and houses elements of a pressure-operated control system that assures safe operation of the loading station. Operating pressure for the motorized control valves is tapped from a location downstream of the one-way check valves, and such pressure must be above a preset minimum value or the associated motor valves cannot be operated. This preset minimum pressure value will normally be present only if the associated loading boom assembly is connected with a pressure vessel, which assures that natural gas will not be discharged at the site unless conditions for loading it have first been correctly established. To allow initial operation of a motor valve to occur, an override arrangement is provided.

The control system includes pressure gauges, to provide the operator with knowledge of all operating conditions during loading. The system for providing operating pressure to the motor valves includes a pair of pressure regulators connected in series, with the second pressure regulator in the series being supplied with pressure from a check valve that is pre-set so that it will not operate unless it senses a pressure greater than a selected minimum. As noted earlier, this selected minimum pressure will normally not be present unless the associated loading boom assembly is properly connected to a pressure vessel.

In one embodiment, the loading station also includes an automatic switchover control system, especially useful in practicing the method of U.S. Pat. No. 4,213,476. The automatic switchover system is connected with the control boxes arranged to operate the two motor valves and, if not required or desired for a particular installation, can be easily removed without affecting the rest of the system.

It is an object of the present invention to provide an improved loading station for loading natural gas into a movable pressure vessel, that is designed to be easily portable from place to place and to provide a maximum of operating safety while handling natural gas.

Another object of the invention is to provide a loading boom assembly for connecting a natural gas loading station with a movable pressure vessel, and designed to provide safe operation and a long service life, and to be easily adjustable universally so that an operator can rapidly connect a pressure vessel to the loading station without difficulty.

A further object of the invention is to provide an equipment skid for mounting the components of a natural gas loading station, designed to be easily moved about and to provide protection for the components mounted thereon.

Yet another object of the invention is to provide a pressure-operated control system for a natural gas loading station, designed to be easily transported and to provide a maximum of safety in handling natural gas.

Still another object of the invention is to provide a pressure-operated control system that includes as a detachable feature an automatic system for effecting switchover from one pressure vessel to another during the filling operation.

Other objects and many of the attendant advantages of the present invention will become readily apparent from the following detailed Description of the Preferred Embodiments, when taken in conjunction with the accompanying drawings.

DESCRIPTION OF THE PREFERRED EMBODIMENTS

Figure 1:
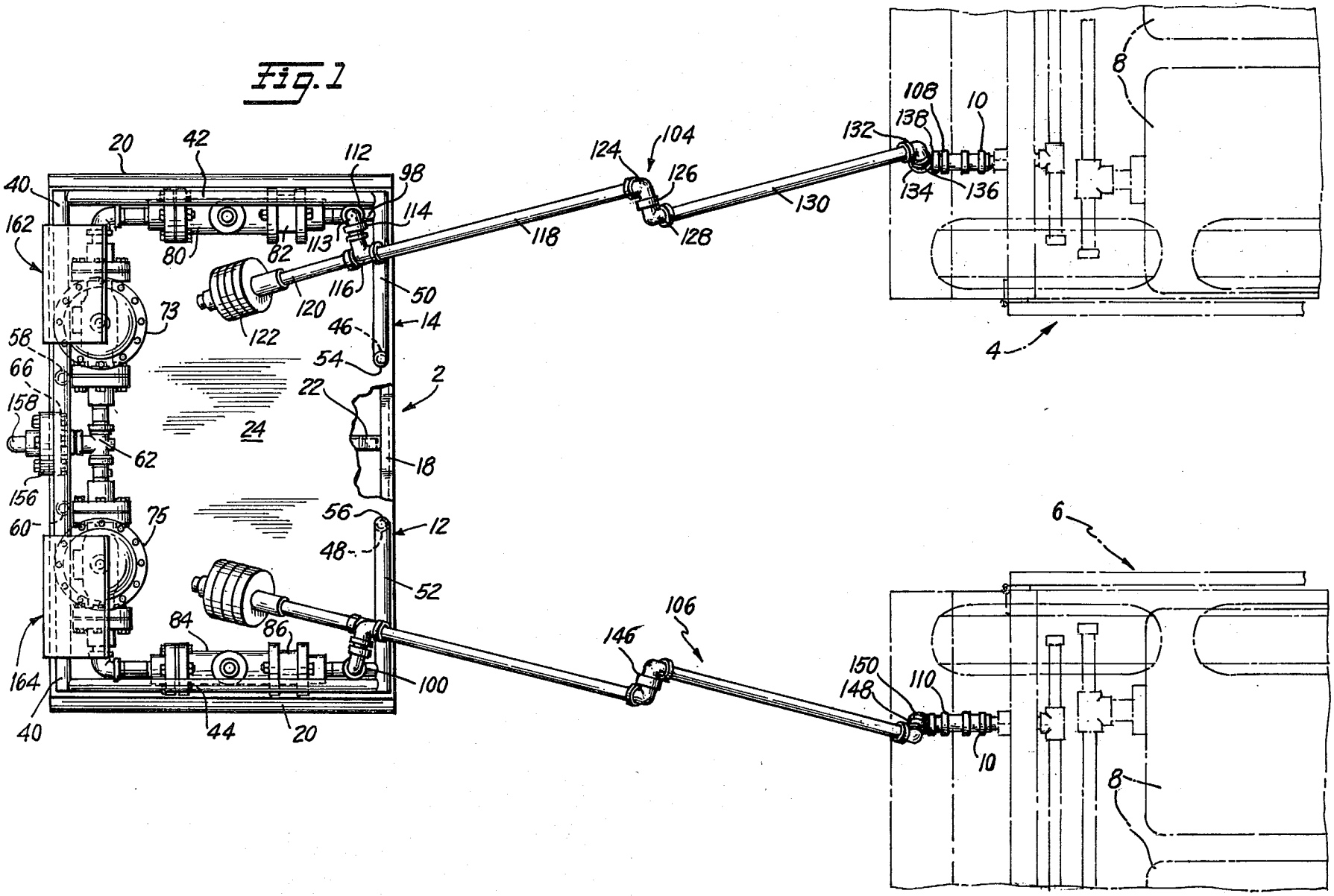
FIG. 1 is a plan view of the natural gas loading station of the invention, with the loading boom assemblies shown connected to truck-mounted pressure vessels.

Referring now to FIG. 1 of the drawings, the loading station of the invention is indicated generally at 2, and parked adjacent thereto are two vehicles 4 and 6 to be loaded with natural gas. The vehicles 4 and 6 are identical, and are constructed like those discussed in the two patents cited earlier. Each carries pressure vessels 8 thereon, and each includes a vehicle loading manifold system similar to that described in U.S. Pat. No. 4,139,019. Each loading manifold system includes one half 10 of a quick connect-disconnect connector, for connecting the associated pressure vessels 8 to the natural gas loading station 2. For purposes of aiding description of the invention, the vehicle 4 in FIG. 1 will be assumed to be on the left-hand side of the loading station 2, and the vehicle 6 on the right-hand side.

The loading station 2 includes a movable equipment skid 12, upon which the valves and other components of the system are mounted. The equipment skid 12 has a load platform 14 which includes front and rear channel members 16 and 18, joined at their opposite ends by tubular members 20 and centrally by a cross-member 22. The platform 14 is of welded construction, and further includes a floor plate 24 secured to the front and rear members 16 and 18 and resting on the cross-member 22. The tubular members 20 have a diameter equal to about one-half the height of the channel members 16 and 18, and are received and welded within arcuate cut-outs 26 in the upper corners of the outer ends of these members. The lower, outermost corners 28 of the members 16 and 18 are cut at/an angle, and short angled transverse skid plates 30 are welded in place on each end of the members 16 and 18 to provide a smooth surface.

The skid plates 30 make it easy to slide the equipment skid 12 across the earth in either direction, and to load and unload it from a truck or other vehicle. Further, it will be noted that the tubular members 20 are open at both ends. This makes it possible to insert a lengthy rod (not shown) through either or both of the tubular members 20, to which a hoist, chain or other device can be connected to lift or tow the equipment skid.

A pair of tubular front corner posts 32 and 34 are welded to extend vertically from the floor plate 24, and a corresponding pair of tubular rear corner posts 36 and 38 are welded to the rear corners of the platform 14. The four corner posts 32, 34, 36 and 38 function to support horizontal tubular rail elements, which include a front rail 40, and end rails 42 and 44, all welded in position.

Figure 4:
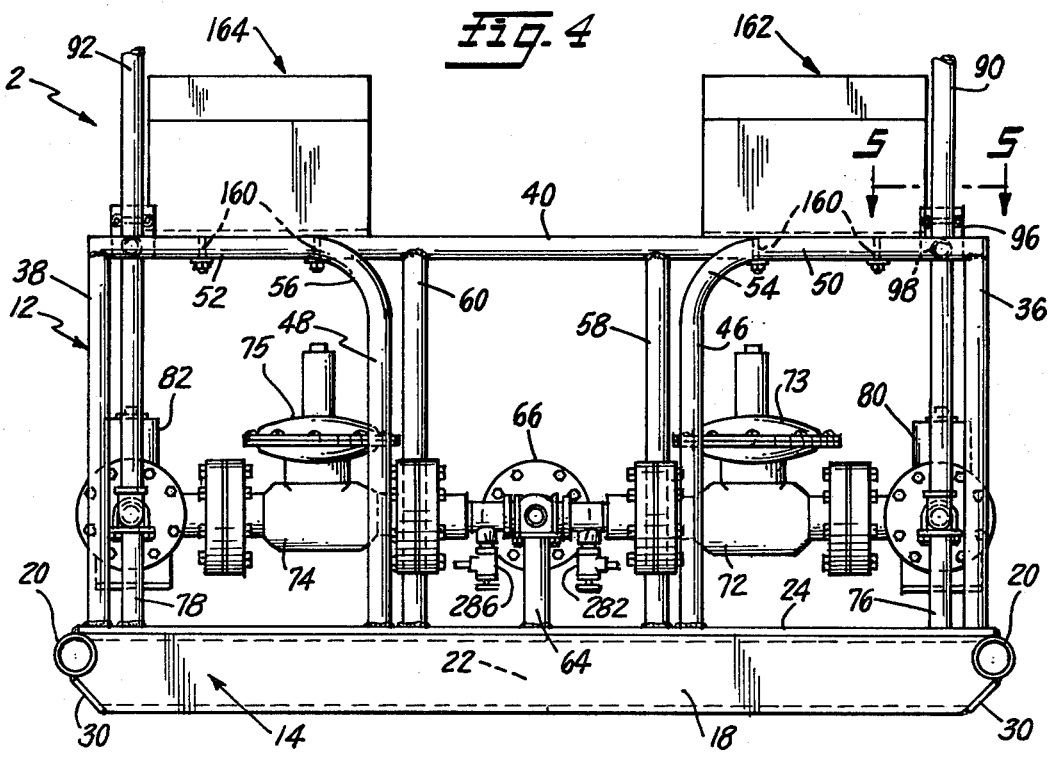
FIG. 4 is a rear elevational view of the loading station, and shows the access opening provided in the equipment skid railing.

A tubular gate post 46 is welded to extend vertically upward from the rear edge of the floor plate 24 about one third of the way in from the left-hand end of the platform 14, and a mating tubular gate post 48 is positioned about one third of the way in from the right-hand end of the platform. A passageway is defined between the two gate posts 46 and 48, to provide access to the platform 14 of the equipment skid. As is best seen in FIG. 4, the two gate posts 46 and 48 are actually one-piece L-shaped tubular members, and include horizontal rail portions 50 and 52, respectively, joined to the vertical posts by curved transition sections 54 and 56. The outer ends of the horizontal rail portions 50 and 52 are welded to the tops of the corner posts 36 and 38, respectively, and to the ends rails 42 and 44.

The arrangement of the corner posts 32, 34, 35 and 38, the gate posts 46 and 48, and the horizontal rails 40, 42, 44, 50 and 52 functions both to provide a protected area on the platform 14 of the equipment skid that will not be prone to accidental entry by persons or animals, and to support components of the loading station. While the gate posts 46 and 48 and their associated horizontal rail sections 50 and 52 could alternatively meet at a right angle or be made of separate tubular members, the integral construction shown with the curved transition sections 54 and 56 provides significant structural strength to the equipment skid and adds considerably to its ornamental appearance. The strength of the equipment skid is further enhanced by a pair of tubular front brace posts 58 and 60, welded to extend vertically between the floor plate 24 and the front rail 40 and spaced somewhat closer together than the gate posts 46 and 48. The use of tubular material for the posts and the coils and the arrangement of the tubular members 20 and the skid plates 30 also help to give the equipment skid a pleasing appearance.

Mounted on the floor plate 24 centrally of the front of the equipment skid 12 is a T-shaped intake fitting 62, the fitting being supported on the platform 14 by a central short vertical standard 64 and including an outwardly facing intake flange 66. Two end supporting standards 68 and 70 are positioned on the right- and left-hand ends of the skid platform 14, and together with the intake fitting 62 and the central standard 64 support the opposite ends of a pair of motorized flow-control valves 72 and 74. The motorized valves 72 and 74 are operated by fluid pressure that acts upon a diaphragm mounted within housings 73 and 75 carried on the valves, and are of a type that is commerically available.

Mounted at the rear corners of the platform 14 are right- and left-hand rear support standards 76 and 78, the post 76 serving with the standard 68 to support in series moving outwardly from the motorized valve 72 a manual flow control valve 80 and a one-way check valve 82, the latter being constructed to permit flow only in an outward direction away from the valves 72 and 80. Similarly, the left hand rear standard 78 and the standard 70 support a manual flow control valve 84 and a one-way check valve 86, the latter also being arranged to allow only outward flow. The manual valves 80 and 84 provide back-up to the motorized valves 72 and 74, should these fail or be down for repairs.

Figures 2, 5, 6:
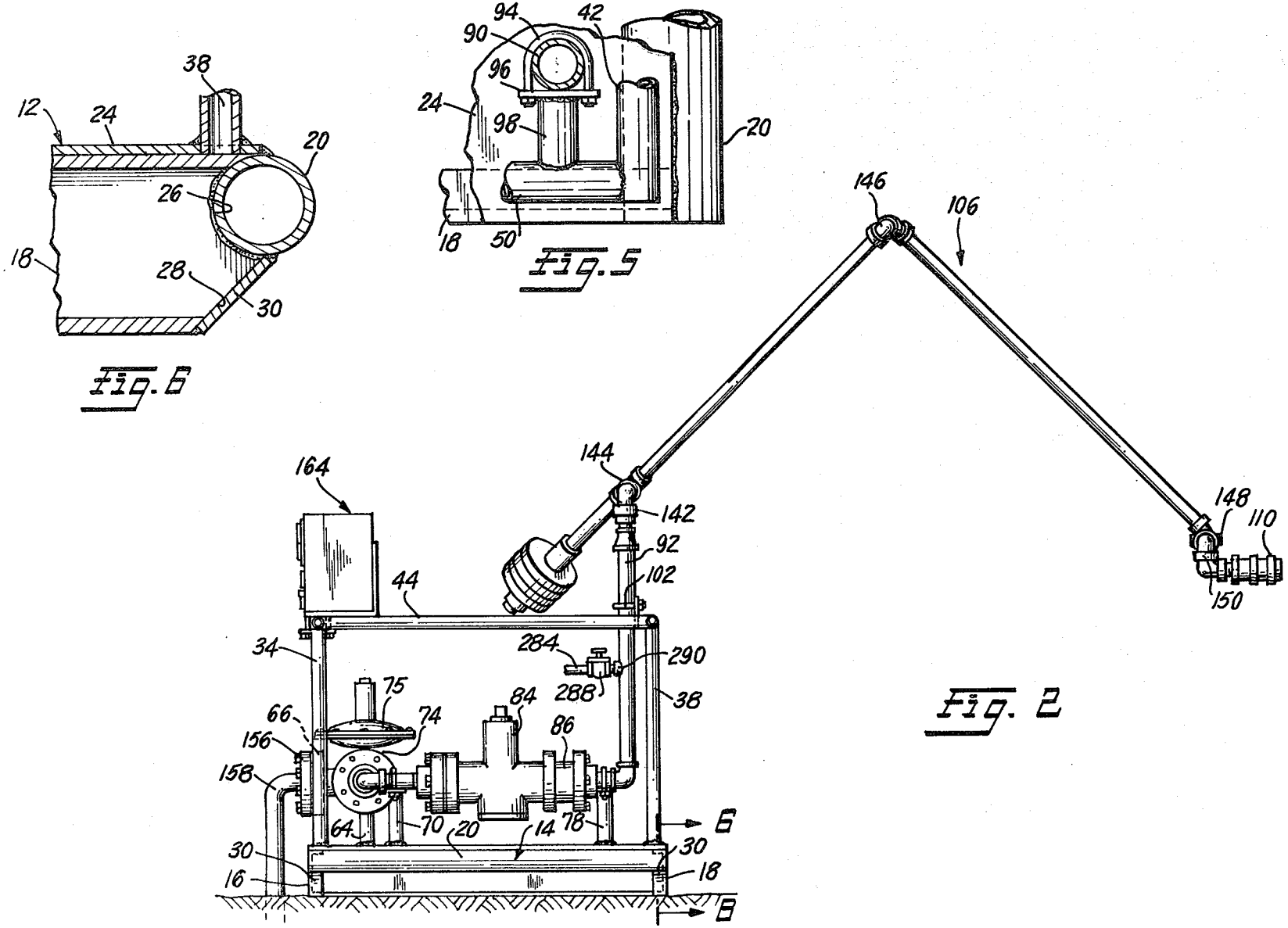
FIG. 2 is a side elevational view of the loading station of FIG. 1, and shows in particular the relative positions of the motor flow control valves, the manual flow control valves and the check valves, and construction details of the loading boom assemblies.
FIG. 5 is an enlarged, fragmentary horizontal sectional view taken on the line 5—5 of FIG. 4, showing how the vertical post of one of the loading boom assemblies is mounted on the equipment skid.
FIG. 6 is an enlarged, fragmentary vertical sectional view taken on the line 6—6 of FIG. 2, showing construction details of the equipment skid base.

The outlet of the one-way check valve 82 is connected to the lower end of a vertical conduit 90, and a similar vertical conduit 92 is connected to the outlet of the right-hand one-way check valve 84. As shown in FIG. 5, the vertical conduit 90 is secured in place by a U-bolt 94, which clamps it to a plate 96 welded to the outer end of a stub shaft 98 which in turn is welded to the horizontal rail section 50. A similar stub shaft 100 is welded to the right-hand rail section 52, and the vertical conduit 92 is secured thereto by a U-bolt 102. The vertical conduits 90 and 92 serve both to support right- and left-hand loading boom assemblies 104 and 106, respectively, and to conduct natural gas under pressure that will typically be in the 2,000 to 3,000 psi range. Thus, the conduits 90 and 92 need to be made of high quality steel or other material capable of handling such pressures for an indefinite period of time.

The boom assemblies 104 and 106 are of identical construction, and hence only the left-hand assembly 104 will be described in detail. In essence, each boom assembly is designed to include five swivel couplings, arranged to provide essentially universal movement for quick connect-disconnect connector elements 108 and 110 mounted on the outer ends of the assemblies 104 and 106, respectively. This universal movement extends to both the vertical and horizontal planes, and makes it possible for an operator to quickly and easily connect the loading station 2 with the vehicle loading manifolds of pressure vessels parked within the operational range of the boom assemblies. Further, the boom assemblies both include a counterweight arrangement, arranged so that the connector elements 108 and 110 can be moved about with a minimum of effort.

Referring again to the drawings, the upper end of the left-hand vertical conduit 90 has a swivel coupling 112 mounted thereon, arranged so that its axis of rotation is vertical. The upper end of the swivel coupling 112 has the lower end of an elbow 113 connected thereto, the outer end of the elbow 113 being connected with a swivel coupling 114 arranged with its axis of rotation lying in a horizontal plane. Connected to the other side of the swivel coupling 114 is a T-shaped fitting 116 of the type that includes a through elbow on one leg and a threaded blind bore for the other leg, the open outer end of which is connected to one end of an inner boom section 118. The blind, rear end of the T-fitting 116 has a tubular counterbalancing arm 120 connected thereto, which has counterweights 122 on its outer end.

The outer end of the inner boom section 118 has an elbow fitting 124 thereon, which connects with a swivel coupling 126 arranged so that its axis of rotation is in the horizontal plane. The other end of the swivel coupling 126 has an elbow fitting 128 connected thereto, to the outer end of which is connected one end of an outer boom section 130 that carries an elbow fitting 132 on its other end. The elbow fitting 132 is connected with a swivel coupling 134, also arranged with its axis of rotation lying in a horizontal plane. Thus, the axes of rotation of the swivel couplings 114, 126 and 134 lie parallel to each other in the horizontal plane.

Connected to the other end of the swivel coupling 134 is an elbow fitting 136, the other end of which is connected with a final swivel coupling 138 arranged with its axis of rotation lying in a vertical plane. The other end of the final swivel coupling 138 has an elbow fitting 140 connected thereto, which has the quick connect-disconnect coupling element 108 mounted thereon.

It will be seen that the five swivel couplings 112, 114, 126, 134 and 138 cooperate with each other to provide for universal movement of the coupling element 108 over the operating range of the boom assembly 104. The swivel coupling 112 allows the boom assembly 104 to be pivoted to the right or left about the vertical axis of the conduit 90. The swivel couplings 114, 126 and 134 allow the boom assembly 104 to be shortened through a scissors-like motion, centered on the swivel coupling 126. The swivel coupling 138 allows the connector element 108 to be pivoted in a horizontal plane, and the three swivel couplings 114, 126 and 134 allow adjustment of the coupling element 108 in a vertical plane. By choosing the correct length for the counterbalancing arm 120 and the correct position and weight for the counterweights 122, movements of the connector element 108 into position will require very little effort.

It is to be understood that the swivel couplings 112, 114, 126, 134 and 138, the boom conduit sections 118 and 130, and the several fittings must all be constructed to safely handle natural gas under pressures up to at least 3,000 psi, over a prolonged operational period. It has been found that this can be accomplished, since swivel couplings, fittings and conduits capable of meeting this standard are readily available. The boom assemblies of the invention have been found to provide significantly superior results over the flexible hose arrangements shown in the cited patents. Not only are the boom assemblies of the invention easy for an operator to utilize, but the life thereof is much longer than the flexible hose arrangements earlier used.

Returning to the drawings, the loading boom assembly 106 includes swivel couplings 142, 144, 146, 148 and 150, which correspond to the swivel couplings 112, 114, 126, 134 and 138 of the loading boom assembly 104 and function in a like manner. It should also be noted that the connector portions 108 and 110 can be rotated about their axes, to provide another degree of adjustment.

Figure 7:
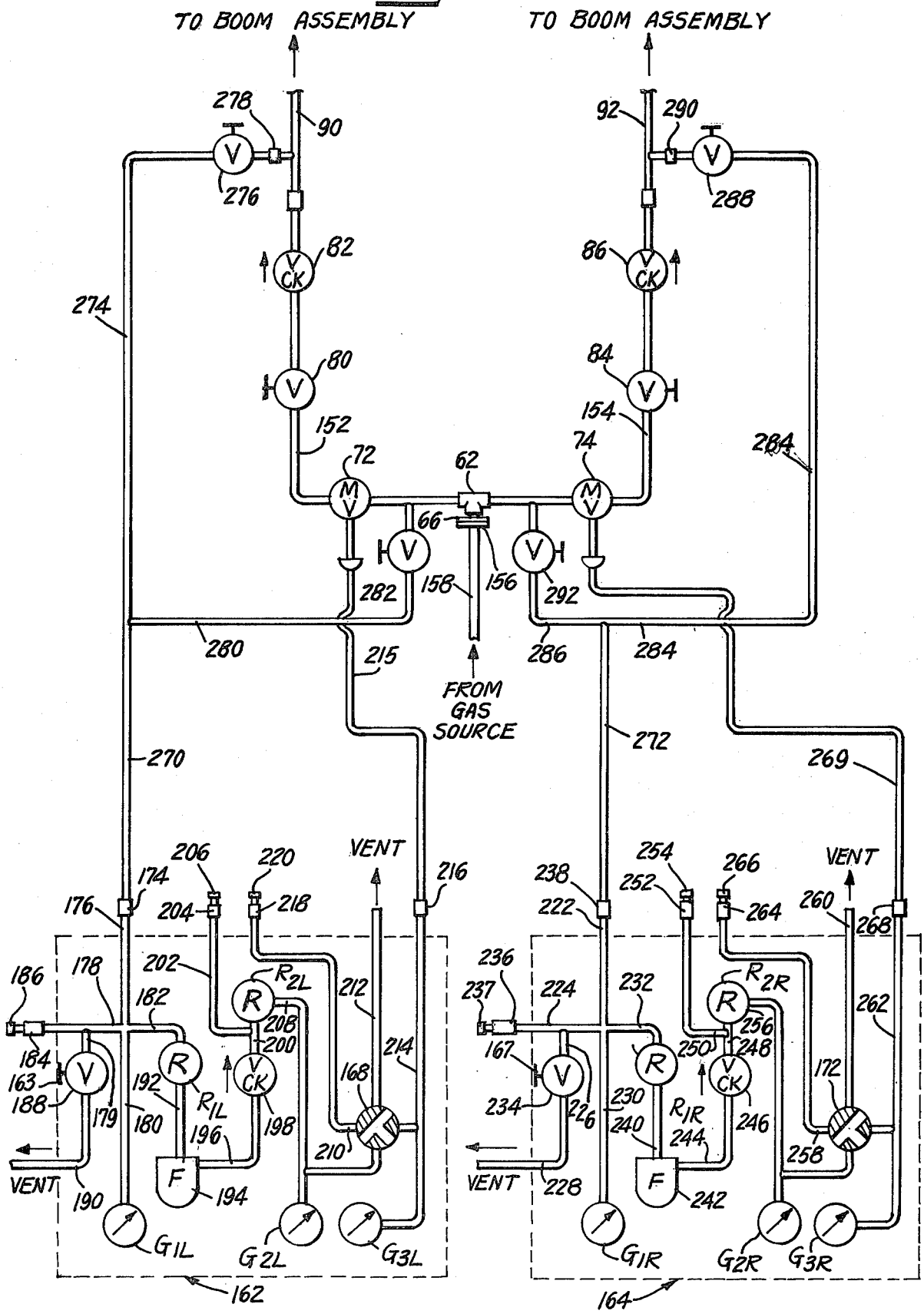
FIG. 7 is a schematic diagram of the pressure-operated control circuit for the loading station of FIG. 1.

Turning now to FIG. 7, the pressure control system for the loading station 2 is shown in diagrammatic form, with the motorized flow-control valves 72 and 74, the manually operated back-up valves 80 and 84 and the one-way check valves 82 and 86 being shown connected into left-hand and right-hand loading conduits 152 and 154, respectively, both leading from the centrally positioned, T-shaped intake fitting 62. The intake flange 66 of the fitting 62 is connected with a flange 156 carried on a natural gas supply conduit 158 leading from suitable conditioning equipment, which, if desired, can be buried as shown in FIG. 2. As noted earlier, the natural gas conditioning equipment will usually include a dehydrator unit and an oil-gas separator, and may also include a compressor. This equipment functions to prepare the natural gas for transport, and supply it to the intake fitting 62 at an operating pressure in excess of about 800 psi, and usually in the 2,000 to 3,000 psi range, as is described in the two patents cited above.

Mounted on the front rail 40 of the equipment skid 12 by brackets 160 are left-hand and right-hand control boxes 162 and 164, respectively, which house the elements of the pressure control system of the invention. The face of the left-hand control box 162 has pressure gauges $G_{1L}$, $G_{2L}$ and $G_{3L}$ mounted thereon, along with a valve handle 163 for operating a relief valve 188 (FIG. 7), a control knob 165 for setting an adjustable pressure regulator $R_{2L}$ (FIG. 7), and a handle 166 for operating a three-way valve 168 (also shown in FIG. 7). Similarly, the right-hand control box 164 carries on its face pressure gauges $G_{1R}$, $G_{2R}$ and $G_{3R}$, a valve handle 167 for a relief valve 234, a control knob 169 for an adjustable pressure regulator $R_{2R}$, and an operating handle 170 for a three-way valve 172, the regulator and the valves 234 and 172 being shown in FIG. 7. The faces of the two control boxes are elevated for easy observation, because of their position on the rail 40.

Referring again to FIG. 7, the pressure control system elements within the two control boxes 162 and 164 are identical. Turning first to the left-hand control box 162, natural gas tapped from the loading station 2 enters the box through a coupling 174 connected to a feed conduit 176. The feed conduit 176 divides into three branches, 178, 180 and 182, with the branch 178 leading to a coupling 184 that is shown as closed in FIG. 7 by a cap 186. A conduit 179 leads from the branch 178 and through the manually operated relief valve 188 to a vent conduit 190. The branch 180 connects with the pressure gauge $G_{1L}$.

The branch conduit 182 supplies natural gas under high pressure to a first pressure regulator $R_{1L}$, which is selected to reduce the pressure of the natural gas from its normal initial value of from 2,000 to 3,000 psi down to about 200 psi. The outlet of the pressure regulator $R_{1L}$ is connected by a conduit 192 to a filter 194, and the filter 194 is in turn connected by a conduit 196 to a one-way check valve 198 arranged to allow flow only in a downstream direction and which is preselected to open only when pressure on the inlet side thereof exceeds a preselected minimum value. The outlet of the check valve 198 is connected by a conduit 200 to the inlet of the second pressure regulator $R_{2L}$, and a branch conduit 202 leads from the conduit 200 to a connector 204 that is also provided with a cap 206 in FIG. 7.

The second pressure regulator $R_{2L}$ can be set to a selected value by adjusting its control knob 165 on the front panel of the control box 162, and is intended to reduce the pressure of the natural gas down to about 60 psi to make it suitable for application to the diaphragm or another pressure-operated motor of the motorized control valve 72. Natural gas leaves the second pressure regulator $R_{2L}$ via a conduit 208 that is connected with the pressure gauge $G_{2L}$, and leads to the supply port of the three-way valve 168, shown symbolically in the drawings. The gauge $G_{2L}$ thus monitors the performance of the second regulator $R_{2L}$.

The other three ports of the three-way valve 168 have conduits 210, 212 and 214 connected thereto, the conduit 212 being a vent, the conduit 214 being used to supply operating pressure to the motorized control valve 72 and having a connector 216 on its outer end, and the conduit 210 leading to a connector 218 that is provided with a cap 200 as shown in FIG. 7. A conduit 215 leads from the connector 216 to the motorized control valve 72. By turning the handle 166, the three-way valve can be set to any one of three settings: a first setting in which the conduit 208 is connected with the supply conduit 214 and the conduits 210 and 212 are closed; a second setting in which the supply conduit 214 is connected to the vent conduit 212, to thereby vent the motorized control valve 72 and effect its closing; and a third setting in which the conduit 210 is connected with the supply conduit 214 and the conduits 208 and 212 are closed off. The supply conduit 214 is also connected with the gauge $G_{3L}$, which thus is effective to measure the pressure being applied to the diaphragm of the motorized control valve 72.

The control box 164 includes conduits 222, 224, 225, 228, 230 and 232, corresponding to the conduits 176, 178, 179, 190, 180 and 182, respectively, of the control box 162, all leading to a first pressure regulator $R_{1R}$ and the pressure relief valve 234. The conduits 222 and 224 are provided with connectors 236 and 238, respectively, the connector 236 being closed by a cap 237 as shown in FIG. 7. A conduit 240 is connected with a filter 242, and the outlet of the filter is connected by a conduit 244 with a one-way check valve 246 that corresponds to the one-way valve 198. A conduit 248 leads from the one-way valve 246 to the second pressure regulator $R_{2R}$, and a branch 260 thereof passes out of the control box 164 and has a connector 252 thereon which is provided with a cap 254 in FIG. 7. The outlet of the second regulator $R_{2R}$ is connected by a conduit 256 to the pressure gauge $G_{2R}$ and the inlet port of the three-way valve 172, the valve 172 having conduits 258, 260 and 262 connected thereto that correspond to the conduits 210, 212 and 214, respectively. The conduit 258 has a connector 264 thereon closed by a cap 266 as shown in FIG. 7, and the conduit 262 terminates in a connector 268 that connects with a conduit 269 leading to the motorized valve 74. The three-way valve 172 functions like the three-way valve 168, to transmit and drain pressure to and from the diaphragm of the motorized control valve 74.

Operating pressure is supplied to the conduits 176 and 222 by tap lines 270 and 272, respectively. The tap line 270 includes a first branch 274 that is connected to a manually operated isolation valve 276 connected with a fitting 278 on the vertical conduit 90, and which will normally be open during operation of the loading station. The tap line 270 also has a second branch 280, which is connected through a normally closed manually operated valve 282 to the loading conduit 152, upstream of the motorized control valve 72.

The tap line 272 also includes two branches 284 and 286, the former being connected to a manually operated isolation valve 288 mounted on a fitting 290 carried by the vertical conduit 92, and which corresponds to the isolation valve 276. The branch conduit 286 is connected through a manually operated valve 292 to the loading conduit 154 upstream of the motorized control valve 74. It will be seen that natural gas can be admitted to the control boxes 162 and 164 either by use of the valves 276 and 288, or by use of the valves 282 and 292, respectively.

The control system of the invention is designed so that it will not be operational unless a predetermined pressure level is present at the second pressure regulators $R_{2L}$ and $R_{2R}$. More specifically, the second pressure regulators $R_{2L}$ and $R_{2R}$ are arranged so that natural gas will pass therethrough only when that natural gas has a pressure exceeding the pre-selected minimum opening pressure of the one-way check valves 198 and 246, usually about 175 psi. Absent this minimum pressure value, no gas pressure will be passed to the three-way valves 168 and 172 and the motorized control valves 72 and 74 will remain closed. The motorized control valves 72 and 74 are of the type that require the application of adequate pressure on their operating diaphragms before they will open, and absent such pressure the valves remain closed.

The minimum-pressure feature assures that the loading station motorized control valves 72 and 74 will not be accidentally opened, as will be explained. Thus, it contributes to safe handling of the natural gas. The necessary minimum pressure can be applied to the check valves 198 and 246 in one of two ways.

When the loading station 2 is first taken to a gas well site and installed, the flanges 66 and 156 will be connected and natural gas under high pressure can then reach the two motorized control valves 72 and 74. Initially, however, there will be no pressure in the loading conduits 152 and 154 in the region beyond the two closed motorized valves. In order to make the system operational, the two manually operated flow-control valves 80 and 84 must first be opened.

A vehicle with the pressure vessels thereon is then moved into place adjacent the loading station 2, and the loading boom assembly 104 is utilized to connect the loading manifold of the pressure vessels with the vertical conduit 90. At this time the isolation valve 276 will be closed, as is the valve 282. A second vehicle with pressure vessels can then be connected to the right-hand loading boom assembly 106, and the valves 288 and 292 will also initially close.

Figure 3:
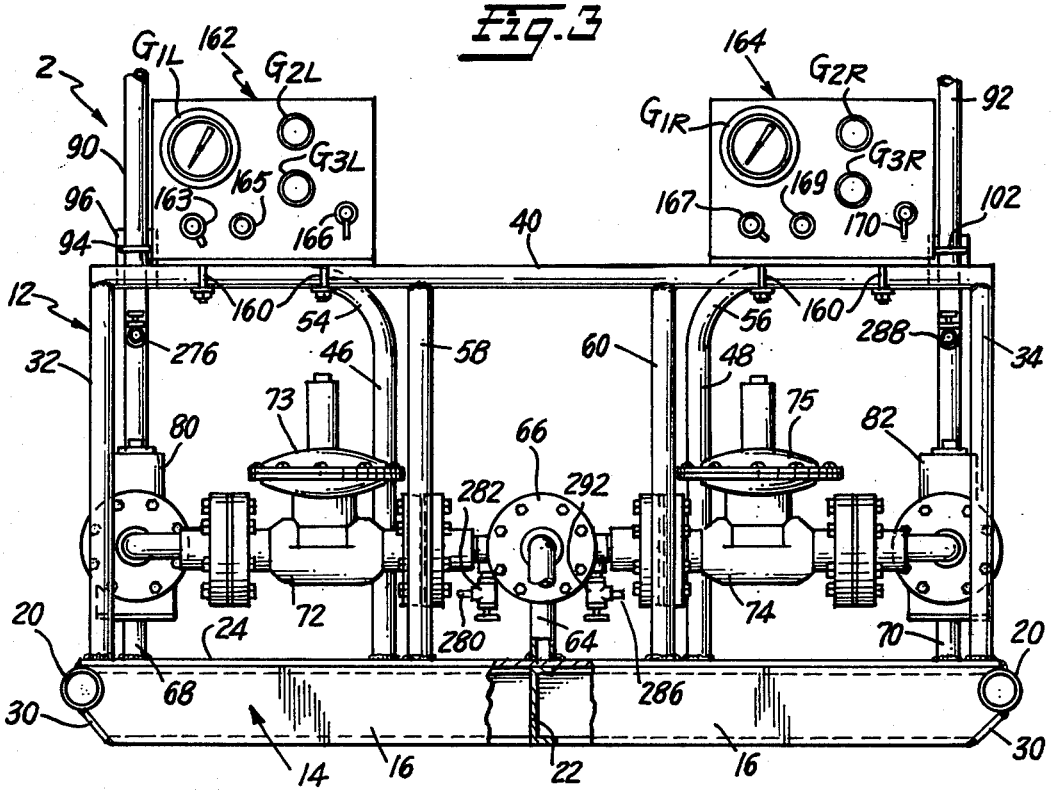
FIG. 3 is an enlarged, elevational view of the front of the loading station, and in particular shows the two control boxes and how they are mounted on the railing of the equipment skid.

If the pressure vessels on the two vehicles have previously been utilized to transport natural gas under pressure, there is usually some residual pressurized natural gas contained therein. When the pressure vessels are connected to the two loading boom assemblies, this residual pressurized natural gas will flow into the two vertical conduits 90 and 92, but cannot flow past the one-way check valves 82 and 86. Typically, the pressure of the residual natural gas will be about 200 psi or so, and this residual pressure is utilized when possible to initiate operation of the pressure control systems of the loading station 2. Referring to U.S. Pat. No. 4,139,019, the pressure vessels 12 in FIG. 3 thereof are provided with a loading manifold system 40 that includes a flow-control valve 60 and one portion 66 of a quick connect-disconnect connector, and these components are utilized in conjunction with the present invention to control the flow of natural gas during loading of the pressure vessels. The connector portion 66 of the patent corresponds to the connector portions 10 herein.

Assuming it is desired to first fill the left-hand pressure vessels, the three-way valve 168 is operated to connect the conduits 208 and 214, and the isolation valve 276 is then opened. Usually, opening of the isolation valve 276 allows pressurized residual natural gas present in the vertical conduit 90 to flow through the branch conduit 274 and the conduit 270 into the control box 162. If the residual pressure is greater than the minimum setting of the check valve 198 then pressure will flow through the second pressure regulator $R_{2L}$. Otherwise, this regulator will not be operational to pass pressure to the motorized control valve 72.

If the check valve 198 opens then pressure will flow to the second regulator $R_{2L}$ and the motorized flow-control valve 72, and the valve will open to admit natural gas under high pressure to the open control valve 80 and the one-way check valve 82, and the vertical conduit 90. As the natural gas pressure increases in the conduit 90, so will the gas pressure applied to the first pressure regulator $R_{1L}$. However, the first pressure regulator will not pass more than its pre-set pressure to the second pressure regulator $R_{2L}$, typically about 200 psi. The gauges $G_{1L}$, $G_{2L}$ and $G_{3L}$ allow the operator to monitor the pressure and flow of natural gas, and the second pressure regulators are adjusted to provide the desired opening pressure to their motorized control valves.

When the first pressure vessels are filled, the isolation valve 288 is opened to admit pressurized residual natural gas from the second pressure vessels to the control box 164. Assuming the pressure reaching the check valve 246 for the second pressure regulator $R_{2R}$ of the right-hand system is sufficient, and that the three-way valve 172 has been properly set to connect the conduits 256 and 260, then the motorized control valve 74 will be opened to commence flow into the second pressure vessels. Flow to the first pressure vessels can then be terminated by operating the three-way control valve 168, to connect the motorized control valve 72 with the vent 212. This will result in a loss of operating pressure, and the valve 72 will then close. Once the valve 72 is closed, the procedure for disconnecting the first pressure vessels from the loading boom assembly 104 is commenced.

As is explained in the two prior patents, for safe handling of the natural gas it is necessary to first drain the pressure from the loading boom assembly 104 before the connector 108 is disconnected. This is done after the flow-control valve included in the vehicle loading manifold arrangement is closed, and is accomplished by operating the handle 163 to open the relief valve 188. Pressure is then drained from the conduits 175 and 270, and from the vertical conduit 90. Once this has been accomplished, the quick connect-disconnect connector can be opened with complete safety. The first vehicle is then moved, and replaced with one having empty pressure vessels. The relief valve 188 is then closed, and the quick connect-disconnect connector is made up. The flow control valve on the vehicle manifold system is then opened to admit residual natural gas under pressure from the empty pressure vessels to the vertical conduit 90, and the left-hand system is then again ready for operation. When the second pressure vessels are filled, a switchover from the right-hand system is then made in a manner like that just described for the left-hand system.

If the residual pressure from the connected pressure vessels is insufficient to operate the associated second pressure regulator, then the appropriate manually operated valve 282 or 292 can be cracked open. This will admit high pressure natural gas to the conduit 280 or 286, adequate to effect opening of the associated second pressure regulator. Once the system has thus been primed and the associated motorized control valve 72 or 74 opens, the valves 282 or 292 is again closed. It has been found in practice that the valves 282 and 292 seldom are needed, except of course for initial start up with pressure vessels being placed in service for the first time, which contain no residual natural gas.

Looking again at the normal operating mode of the second pressure regulators $R_{2L}$ and $R_{2R}$, these will not be operational unless the necessary minimum pressure is supplied to them from the vertical conduits 90 or 92. The conduits 90 and 92, as has been explained, are vented before the quick connect-disconnect connector is uncoupled, so that no significant pressure resides therein. During the time when the associated loading boom assembly is not connected to pressure vessels, this condition remains. Thus, it is not possible for the second pressure regulators to operate during this period, unless the associated valve 282 or 292 is utilized. Accordingly, accidental operation of the associated motorized control valve 72 or 74 cannot occur, which in turn assures that pressurized natural gas will be kept out of the loading boom assembly.

Because they contain no pressurized natural gas when disconnected according to the present invention, should a loading boom assembly become damaged by impact with a truck or other vehicle during movement of the pressure vessels into position, or from some other cause, no escape of natural gas can occur. Further, a workman connecting the loading boom assemblies with the pressure vessels need not fear that the quick connect-disconnect coupling is under pressure. It is only after the connection is made and pressurized residual natural gas flows from the pressure vessels into the loading boom assemblies that the loading station 2 can begin to operate, assuming the valves 282 and 292 are not operated. In order to make it difficult to operate the valves 282 and 292, they are preferably located remote from the control boxes 162 and 164, as shown in the drawings.

Figure 8:
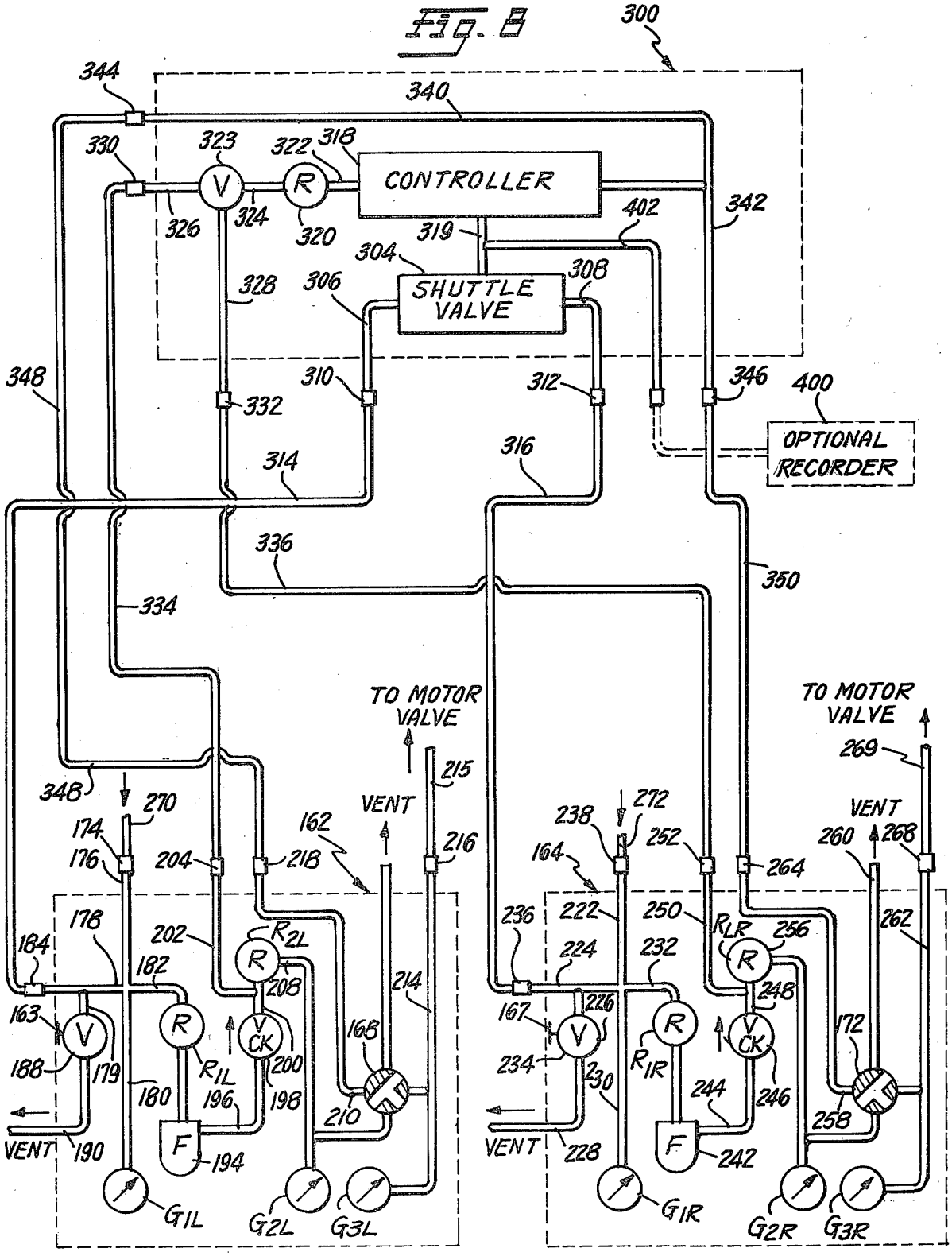
FIG. 8 is a schematic diagram similar to FIG. 7, but showing another embodiment of the invention wherein an automatic switchover control system is connected into the pressure-operated control circuit.

It is sometimes desirable to equip the loading station of the invention so that an automatic switchover from one set of pressure vessels to another can be made, and a pressure control system to accomplish this is shown in FIG. 8. Referring to FIG. 8, the control boxes 162 and 164 shown therein are identical to those shown in FIG. 7. However, the covers 186, 237, 206, 254, 220 and 266 have been removed from their respective connectors, to allow for connection of an automatic switchover system 300 in the circuit.

The automatic switchover control system 300 is mounted within a control box 302 that is also mounted on the equipment skid 12, and includes a shuttle valve 304 having sensing conduits 306 and 308 connected to its two inlet ports, the conduits 306 and 308 in turn terminating in connectors 310 and 312, respectively. Conduits 314 and 316, respectively, connect the connectors 310 and 184 and the connectors 312 and 236. Thus, the shuttle valve 304 is supplied with pressure from the inlet conduits 176 and 222 of the control boxes 162 and 164. The shuttle valve 304 is designed to sense the higher of the two pressures supplied to it and to pass it through a conduit 319 to the controller unit 318, while at the same time flow into the other sensing conduit 306 or 308 is blocked.

The controller unit 318 is supplied with pressure from a pressure regulator 320, connected thereto by a conduit 322. The pressure regulator 320 is in turn supplied with pressure from a selector valve 323 by a conduit 324. The selector valve 323 has two supply ports, which are connected with conduits 326 and 328 that terminate in connectors 330 and 332, respectively. Conduits 334 and 336, respectively, connect the connectors 330 and 204 and the connectors 332 and 252, so that the selector valve 323 is supplied with pressure from the first regulators $R_{1L}$ and $R_{1R}$. The selector valve 323 is of a known type that selects the higher of the two pressures applied to it, and transmits it to the pressure regulator 320, the regulator 320 then acting in a manner like the second pressure regulators $R_{2L}$ and $R_{2R}$ to reduce the pressure down to about 60 psi, suitable for operating the motorized valves 72 and 74.

The outlet port of the controller unit 318 is connected to two branch conduits 340 and 342, which terminate in connectors 344 and 346, respectively. Conduits 348 and 350, respectively, connect the connectors 344 and 218, and the connectors 346 and 264. Thus, when the controller unit 318 is operated, pressure from the pressure regulator 320 is supplied through the associated three-way valve 168 or 172 to the motorized control valves 72 and 74.

In use, the arrangement of FIG. 8 is placed in operation in the same manner as the system of FIG. 7. That is, assuming that the left-hand system is to operate first, this is placed in operation when pressured residual natural gas enters the control box 162 through the conduit 270. The three-way valve 168 is set in the same manner as before, to connect the conduit 208 with the pressure supply conduit 214. The three-way valve 172, however, is now set with the conduits 258 and 262 in communication, so that the pressure supply conduit 262 is connected to the controller unit 318.

Pressure from the inlet conduit 176 will be supplied to the shuttle valve 304 through the conduit 314. This pressure will be larger than any residual pressure found in the conduit 272, since the conduit 176 will be receiving the high pressure natural gas found in the vertical conduit 90. Accordingly, the shuttle valve 304 will shift toward the right, as viewed in FIG. 8, closing off the conduit 308 and thereby prohibiting the higher natural gas pressure in conduit 306 from being applied to the regulator $R_{2R}$.

As the first pressure vessels become filled, the pressure in the conduit 176 will continue to increase until a pre-selected high value is reached, signalling completion of filling. The controller unit 318 is set to respond at this point, and opens to admit pressure from the regulator 320 to the conduits 340 and 342. Since flow from the conduit 340 is closed by the three-way valve 168, this pressure will flow through the conduit 342 to the supply conduit 262 and will open the motorized control valve 74. When this happens, pressure is relieved in the loading conduit 152, and the check valve 82 closes to prevent backflow from the first pressure vessel. Meanwhile, filling of the second pressure vessels occurs.

At some point after the automatic switchover occurs, and while the second pressure vessels are being filled, an operator will deactivate the left-hand system in the manner described earlier and will replace the first pressure vessels of that system with empty pressure vessels. The three-way valve 168 is then turned to connect the conduits 210 and 214, which prepares the automatic switchover control system to effect a switchover from the second pressure vessels to the newly connected empty pressure vessels when the pressure in the second pressure vessels has increased to the critical value indicating completion of filling.

Referring again to FIG. 8, a pressure recording device 400 is shown in dotted lines, connected by a conduit 402 to the conduit 319 connecting the shuttle valve 304 with the pressure controller 318. The recording device 400 will thus register the pressure being supplied to the controller 318, and is shown in dotted lines because it is an optional piece of equipment.

As will be understood from the description of the invention, the present loading station is designed to assure maximum safety in handling natural gas at the gas well site. Further, it is designed to assure ease of handling by the operator, and a long operational life. Because extensive construction at the site is avoided, economies are effected. In addition, because the loading stations 2 can be built under factory-controlled conditions the quality of each station can be assured.

In use, the loading station is transported to the gas well site and unloaded. In some instances, it can then be directly connected with the gas well. This will occur where the natural gas coming from a well is of high quality and very dry, and when the wellhead pressure is in the 2,000 to 3,000 psi range desirable for transport. In most instances, however, the gas well will also require conditioning equipment for the natural gas, which can include a dehydrator, an oil-gas separator and a compressor unit. The loading station of the invention is readily adapted for use by itself, or in connection with such equipment.

Obviously, many modifications and variations of the invention are possible, within the teachings of the present specification and drawings.

We claim:

1. A loading station for use in loading natural gas at high pressure from a source thereof into a pressure vessel, the pressure vessel being eqipped with loading manifold apparatus that includes a flow control valve and one portion of a connector device, and said loading station including:

an intake fitting arranged to be connected with said source of high pressure natural gas;

at least a pair of loading conduit arrangements, each loading conduit arrangement being connected with said intake fitting and including in series moving outwardly therefrom a pressure operated motorized control valve and a one-way check valve arranged to permit flow only in a downstream direction;

at least a pair of loading assemblies, one of said assemblies being connected with each of said loading conduit arrangements downstream of the associated one-way check valve, and each of said assemblies including a connector device portion adapted to be connected with said connector device portion of said loading manifold apparatus; and a pressure control system for operating said pressure operated motorized control valves in response to pressurized natural gas transmitted thereto, said pressure control system including a separate control box for each of said loading conduit arrangements, and each of said control boxes containing a pressure control circuit designed and arranged so that its associated motorized control valve cannot receive operating pressure sufficient to open it until the pressurized natural gas transmitted to said pressure control system reaches a pressure value above a pre-set minimum pressure.

2. A loading station as recited in claim 1, wherein said intake fitting and said loading conduit arrangements are mounted upon an equipment skid, and wherein said equipment skid includes:

a platform, said intake fitting, said motorized control valves and said one-way check valves being mounted on said platform;

a plurality of upright posts connected at their lower ends to said platform; and railing connected with the upper ends of said posts and extending about at least most of the periphery of said platform, said railing supporting said control boxes and helping to support said loading assemblies, and serving to protect against accidental damaging contact with the loading station components mounted on said platform.

3. A loading station as recited in claim 2, wherein said equipment skid further includes:

a pair of tubular members, one of said tubular members being hollow so as to accept therethrough a rod member for use in helping to move the equipment skid.

4. A loading station as recited in claim 3, wherein said tubular members are spaced above the bottom of said platform, and wherein the opposite ends of said platform have angled skid plates secured thereto beneath said tubular members to facilitate sliding of the equipment skid.

5. A loading station as recited in claim 2, wherein said railing does not extend across a portion of one side of said platform, to provide a gateway for an operator to enter on said platform and work on the components mounted thereon.

6. A loading station as recited in claim 1, including additionally:

a manually operated, back-up flow control valve positioned in each of said loading conduit arrangements between the associated motorized control valve and one-way check valve.

7. A laoding station as recited in claim 1, wherein each of said loading assemblies includes:

an upright conduit connected at its lower end with the associated loading conduit arrangement;

an inner boom section, the inner end of said inner boom section being connected with the upper end of said upright conduit by first and second swivel couplings, the axis of said first swivel coupling lying in a vertical plane and the axis of said second swivel coupling lying in a horizontal plane;

an outer boom section, the inner end of said outer boom section being connected with the outer end of said inner boom section by a third swivel coupling, arranged with its axis lying in a horizontal plane; and a fourth swivel coupling mounted on the outer end of said outer boom section and arranged with its axis lying in a horizontal plane, said loading assembly connector device portion being mounted outwardly of said fourth swivel coupling;

said first swivel coupling enabling said loading assembly to be pivoted in a generally horizontal plane about its vertical axis, and said second, third and fourth swivel couplings allowing the horizontal reach of said loading assembly ot be lengthened and shortened by a scissors-like action centered on said third swivel coupling.

8. A loading station as recited in claim 7, wherein said loading assembly connector device portion is connected with said fourth swivel coupling by a fifth swivel coupling, whereby all of said swivel couplings cooperate to allow universal positioning of said connector device portion.

9. A loading station as recited in claim 7, wherein a counterweight arm is connected to extend rearwardly from said inner boom section, said arm having counterweights mounted thereon, and said arm and said counterweights being positioned and arranged so that said loading assembly connector device portion can be moved about with a minimum of physical effort.

10. A movable loading station for use in loading natural gas at high pressure from a source thereof into a pressure vessel, the pressure vessel being equipped with loading manifold apparatus that includes a flow control valve and one portion of a connector device, and said loading station including:

an equipment skid;

an intake fitting mounted on said equipment skid, and arranged to be connected with said source of high pressure natural gas;

at least one loading conduit arrangement mounted on said equipment skid, each loading conduit arrangement being connected with said intake fitting and including in series moving outwardly therefrom a pressure operated motorized control valve and a one-way check valve arranged to permit flow only in a downstream direction:

at least one loading boom assembly, one of said assemblies being connected with each of said loading conduit arrangements downstream of the associated one-way check valve, each of said assemblies including a connector device portion adapted to be connected with said connector device portion of said loading manifold apparatus, and being constructed for universal adjustment to facilitate joining of said connector device portions; and a pressure control system for operating said pressure operated motorized control valves in response to pressurized natural gas transmitted thereto, said pressure control system including a separate control box for each of said loading conduit arrangements, and each of said control boxes containing a pressure control circuit designed and arranged to be operational for supplying operating pressure to and venting it from the associated motorized control valve, each of said control boxes including:

a first pressure regulator, connected to receive pressurized natural gas from its associated loading boom assembly;

a second, adjustable pressure regulator connected to receive pressurized natural gas from said first pressure regulator;

a multi-position control valve having an inlet port connected to receive pressurized natural gas from said second pressure regulator and having a first outlet port connected with the associated motorized control valve and a second outlet connected to a vent, said multi-position control valve being arranged to be set in any one of a plurality of positions, including a first position in which said second pressure regulator is connected with the associated motorized control valve through said first outlet port, and a second position wherein said associated motorized control valve is connected with said vent through said first and said second outlet ports; and a pressure relief valve connected to the inlet said of said first pressure regulator, arranged to be operable for venting pressurized natural gas from the inlet side of said first pressure regulator and from the associated loading boom assembly.

11. A movable loading station as recited in claim 10, further including a check valve on the inlet side of said second pressure regulator to control the flow of natural gas thereto, said check valve establishing a minimum natural gas thereto, said check valve establishing a minimum natural gas pressure value that must be present before flow of pressurized natural gas to said second pressure regulator can occur.

12. A movable loading station as recited in claim 10, wherein said first pressure regulator is supplied with pressurized natural gas from its associated loading boom assembly by a conduit arrangement that includes an isolation valve.

13. A movable loading station as recited in claim 12, wherein said isolation valve is manually operable.

14. A movable loading station as recited in claim 12, wherein said first pressure regulator is also connected by a primer conduit arrangement to the associated loading conduit arrangement upstream of the associated motorized control valve, such primer conduit arrangement having a manually operated flow control valve connected therein that is operable to admit high pressure natural gas to said first pressure regulator when necessary to prime the control box so it can operate.

15. A movable loading station as recited in claim 10, including additionally:

a filter positioned between said first pressure regulator and said second regulator, arranged and connected to filter the natural gas being passed from one regulator to the other.

16. A movable loading station as recited in claim 10, including additionally:

switching apparatus connected with both of said control boxes, and constructed and arranged to effect automatic switching from a first boom assembly to a second boom assembly when a pressure vessel connected with said first boom assembly has been sufficiently filled.

17. A movable loading station as recited in claim 16, wherein said switching apparatus includes:

a controller unit;

a shuttle valve having an outlet port connected with said controller unit and having a pair of inlet ports, one of said inlet ports being connected with the upstream side of each of said first pressure regulators to receive pressurized natural gas therefrom;

a switchover pressure regulator having its outlet connected with the inlet of said controller unit;

a selector valve having an outlet port connected with said switchover pressure regulator and a pair of inlet ports, one of said selector valve inlet ports being connected to the inlet side of each of said second pressure regulators to receive pressurized natural gas therefrom;

each of said multi-position control valves further including a third outlet port, and being setable to a third position wherein said third outlet port is in communication with the associated motorized control valve; and conduit means connecting the outlet of said controller unit with said outlet port of each of said multi-position control valves, constructed and arranged to transmit pressurized natural gas through said third outlet port to the associated motorized control valve when said multi-position control valve is in said third position.

18. A movable loading station as recited in claim 10, wherein each of said control boxes further includes:

a first pressure gauge, connected to measure and indicate the pressure of the natural gas present on the inlet side of said first pressure regulator;

a second pressure gauge, connected to measure and indicate the pressure of the natural gas present on the outlet side of said second pressure regulator; and a third pressure gauge, connected to measure and indicate the pressure of the natural gas being supplied to the associated motorized control valve.

19. A movable loading station for use in loading natural gas at high pressure from a source thereof into a pressure vessel, the pressure vessel being equipped with loading manifold apparatus that includes a flow control valve and one portion of a connector device, and said loading station including:

an equipment skid;

an intake fitting mounted on said equipment skid, and arranged to be connected with said source of high pressure natural gas;

at least a pair of loading conduit arrangements mounted on said equipment skid, each loading conduit arrangement being connected with said intake fitting and including in series moving outwardly therefrom a pressure operated motorized control valve and a one-way check valve arranged to permit flow only in a downstream direction;

at least a pair of loading boom assemblies, one of said assemblies being connected with each of said loading conduit arrangements downstream of the associated one-way check valve, and each of said assemblies including a connector device portion adapted to be connected with said connector device portion of said loading manifold apparatus, each of said loading boom assemblies including:

an upright conduit connected at its lower end with the associated loading conduit;

an inner boom section, the inner end of said inner boom section being connected with the upper end of said upright conduit by first and second swivel couplings, the axis of said first swivel coupling lying in a vertical plane and the axis of said second swivel coupling lying in a horizontal plane;

an outer boom section, the inner end of said outer boom section being connected with the outer end of said inner boom section by a third swivel coupling, arranged with its axis lying in a horizontal plane; and a fourth swivel coupling mounted on the outer end of said outer boom section and arranged with its axis lying in a horizontal plane, said boom assembly connector device portion being mounted outwardly of said fourth swivel coupling;

said first swivel coupling enabling said loading boom assembly to be pivoted in a generally horizontal plane about its vertical axis, and said second, third and fourth swivel couplings allowing the horizontal reach of said boom assembly to be lengthened and shortened by a scissors-like action centered on said third swivel coupling; and a pressure control system for operating said pressure operated motorized control valves in response to pressurized natural gas transmitted thereto, said pressure control system including a separate control box for each of said loading conduit arrangements, and each of said control boxes containing a pressure control circuit designed and arranged so that its associated motorized control valve cannot receive operating pressure sufficient to open it until the pressurized natural gas transmitted to said pressure control system reaches a pressure valve above a pre-set minumum pressure;

each of said control boxes including:

a first pressure regulator, connected to receive pressurized natural gas from its associated loading boom assembly;

a second, adjustable pressure regulator connected to receive pressurized natural gas from said first pressure regulator;

check valve means connected at the inlet of said second pressure regulator, constructed and arranged to establish a minimum pressure that must be exceeded before natural gas can flow to said second pressure regulator;

a multi-position control valve having an inlet port connected to receive pressurized natural gas from said second pressure regulator and having a first outlet port connected with the associated motorized control valve and a second outlet connected to a vent, said multi-position control valve being arranged to be set in any one of a plurality of positions, including a first position in which said second pressure regulator is connected with the associated motorized control valve through said first outlet port, and a second position wherein said associated motorized control valve is connected with said vent through said first and said second outlet ports; and a pressure relief valve connected to the inlet side of said first pressure regulator, arranged to be operable for venting pressurized natural gas from the inlet side of said first pressure regulator and from the associated loading boom assembly.

20. A loading station as recited in claim 1, wherein each of said control boxes of said pressure control system includes:

a first pressure regulator, connected to receive pressurized natural gas from its associated loading assembly;

a second, adjustable pressure regulator connected to receive pressurized natural gas from said first pressure regulator;

check valve means connected at the inlet of said second pressure regulator, constructed and arranged to establish a minimum pressure that must be exceeded before natural gas can flow to said second pressure regulator;

a multi-position control valve having an inlet port connected to receive pressurized natural gas from said second pressure regulator and having a first outlet port connected with the associated motorized control valve and a second outlet connected to a vent, said multi-position control valve being arranged to be set in any one of a plurality of positions, including a first position in which said second pressure regulator is connected with the associated motorized control valve through said first outlet port, and a second position wherein said associated motorized control valve is connected with said vent through said first and said second outlet ports; and a pressure relief valve connected to the inlet side of said first pressure regulator, arranged to be operable for venting pressurized natural gas from the inlet side of said first pressure regulator and from the associated loading assembly.

21. A lodding station as recited in claim 20, wherein said first pressure regulator is supplied with pressurized natural gas from its associated loading assembly by a conduit arrangement that includes an isolation valve.

22. A loading station as recited in claim 21, wherein said first pressure regulator is also connected by a primer conduit arrangement to the associated loading conduit arrangement upstream of the associated motorized control valve, such primer conduit arrangement having a manually operated flow control valve connected therein that is operable to admit high pressure natural gas to said first pressure regulator when necessary to prime the control box so it can operate.

23. A loading station as recited in claim 20, including additionally:

a filter positioned between said first pressure regulator and said second regulator, arranged and connected to filter the natural gas being passed from one regulator to the other.

24. A loading station as recited in claim 20, including additionally:

switching apparatus connected with both of said control boxes, and constructed and arranged to effect automatic switching from a first loading assembly to a second loading assembly when a pressure vessel connected with said first loading assembly has been sufficiently filled.

25. A loading station as recited in claim 24, wherein said switching apparatus includes:

a controller unit;

a shuttle valve having an outlet port connected with said controller unit and having a pair of inlet ports, one of said inlet ports being connected with the upstream side of each of said first pressure regulators to receive pressurized natural gas therefrom;

a switchover pressure regulator having its outlet connected with said controller unit;

a selector valve having an outlet port connected with said switchover pressure regulator and a pair of inlet ports, one of said selector valve inlet ports being connected to the inlet side of each of said second pressure regulators to receive pressurized natural gas therefrom;

each of said multi-position control valves further including a third outlet port, and being setable to a third position wherein said third outlet port is in communication with the associated motor control valve; and conduit means connecting the outlet of said controller unit with said third outlet port of each of said multi-position control valves, constructed and arranged to transmit pressurized natural gas through said third outlet port to the associated motorized valve when said multi-position control valve is in said third position.

26. A loading station as recited in claim 20, wherein each of said control boxes further includes:

a first pressure gauge, connected to measure and indicate the pressure of the natural gas present on the inlet side of said first pressure regulator;

a second pressure gauge, connected to measure and indicate the pressure of the natural gas present on the outlet side of said second pressure regulator; and a third pressure gauge, connected to measure and indicate the pressure of the natural gas being supplied to the associated motorized control valve.

* * * * *